United States Patent [19]

Bertolotti

[11] Patent Number: 4,819,408

[45] Date of Patent: Apr. 11, 1989

[54] MACHINE FOR WRAPPING METAL STRIP COILS

[75] Inventor: Luigi Bertolotti, Incisa Valdarno, Italy

[73] Assignees: Nuova Italsider SpA, Genoa; Bertolotti SpA, Incisa Valdarno, both of Italy

[21] Appl. No.: 935,989

[22] Filed: Nov. 28, 1986

[30] Foreign Application Priority Data

Nov. 28, 1985 [IT] Italy ..... 9529 A/85

[51] Int. Cl.[4] ..... B65B 11/04; B65B 49/12

[52] U.S. Cl. ..... 53/211; 53/380

[58] Field of Search ..... 53/380, 216, 211, 581, 53/587, 204, 409; 493/105

[56] References Cited

U.S. PATENT DOCUMENTS

| | | | |
|---|---|---|---|
| 2,919,527 | 1/1960 | Smith et al. | 53/204 X |
| 2,927,413 | 3/1960 | Turnbull et al. | 53/380 |
| 3,577,703 | 5/1971 | Kohler | 53/380 |
| 3,605,382 | 9/1971 | Andersson | 53/380 |
| 3,633,335 | 1/1972 | Johnson | 53/380 |
| 3,807,132 | 4/1974 | Kamiya | 53/380 X |
| 3,924,375 | 12/1975 | Brenner et al. | 53/380 |
| 4,534,151 | 8/1985 | Schneck et al. | 53/211 X |

*Primary Examiner*—Horace M. Culver

*Attorney, Agent, or Firm*—Young & Thompson

[57] ABSTRACT

The machine, which operates in association with a paper feeder and with a system of rolls for revolving the coil, includes the following equipment: guide rolls resting on the cylindrical surface on the coil; primary folding devices, including screw rollers, for pleating the open ends of the paper against the circular sides of the coil; and secondary folding devices, including additional screw rollers, for bending back the edges of the paper into the hollow core of the coil.

19 Claims, 3 Drawing Sheets

MACHINE FOR WRAPPING METAL STRIP COILS

Figure 1:
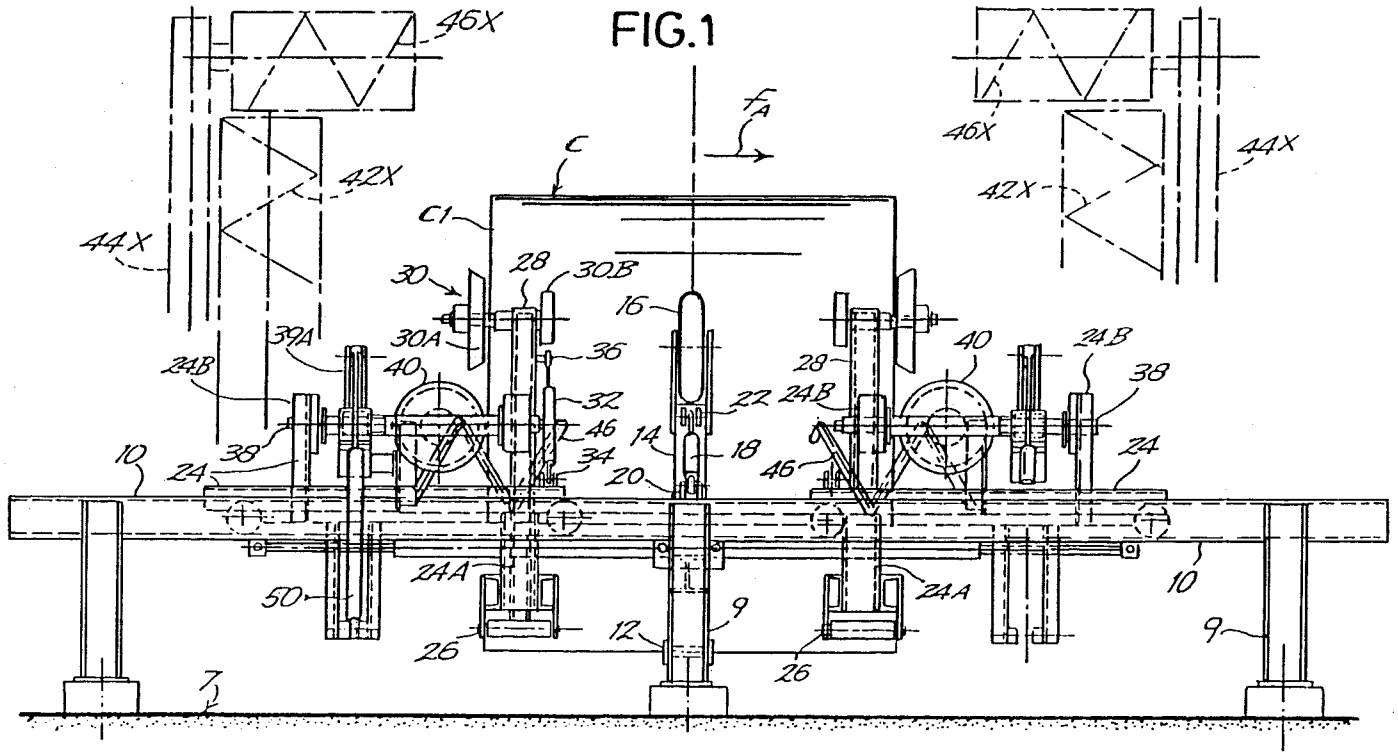

The present invention relates to a machine for wrapping a sheet of thick paper—or similar material—around metal strip coils. The paper wrapping is required before the coil is enclosed in a rigid packaging and, especially, in a metal one.

According to the invention, the machine operates in association with a paper roll feeder and with a system of rolls for revolving the coil and includes the following equipment;

- guide rolls, resting on the cylindrical surface of the coil;
- primary folding device, flanking the cylindrical surface of the coil, for bending and pleating the open ends of the paper against the circular sides of the coil;
- secondary folding devices, for bending back the edges of the paper into the hollow core of the coil.

According to an embodiment of the present invention, the primary folding devices include disks with slanted edges, for example frustoconical edges, which flank the cylindrical surface of the coil and which can be associated with guide rolls.

The primary folding devices also include screw rollers that revolve on axes parallel to the circular bases of the coil in the direction of rotation which favours pleating of the paper by the rounded outer edges of the screw.

According to above embodiment, the secondary folding devices include screw rollers that revolve on axes parallel to the axis of the coil and are insertible to a certain depth within the hollow core of the coil, so as to bend back the edges of the paper immediately after the latter has been pleated by the primary folding devices. Accordingly, the secondary folding devices are movable towards or away from each other along the axis of the coil as well as in a direction parallel to said axis so as to be either partially inserted into or withdrawn from the hollow core of the coil and to cope with different diameters of coils.

Said primary folding devices are also movable towards or away from each other along the axis of the coil, so that the gap between them can be adjusted to match the axial width of the coil.

To obtain above movements, primary and secondary folding devices are, for example, mounted each on a movable carriage that travels on rails laid parallel to the axis of the coil. The machine can be combined with a coil transfer system that moves a single file of coils in the direction of their common central axis. In this case, also said guide rolls, as well said primary and secondary folding devices, are mounted on mobile equipment permitting them to be backed out of the way of the coil advancing into the wrapping station and subsequently moved forward again into their working position.

An embodiment of present invention rotatably mounts said guide rolls and primary and secondary folding devices on hinged arms, which can also be possibly mounted on said movable carriages.

The purpose and characteristics of the invention will be more completely described in the following description with reference to the attached drawings, which reproduces a nonlimitative example of the invention.

Figure 2:
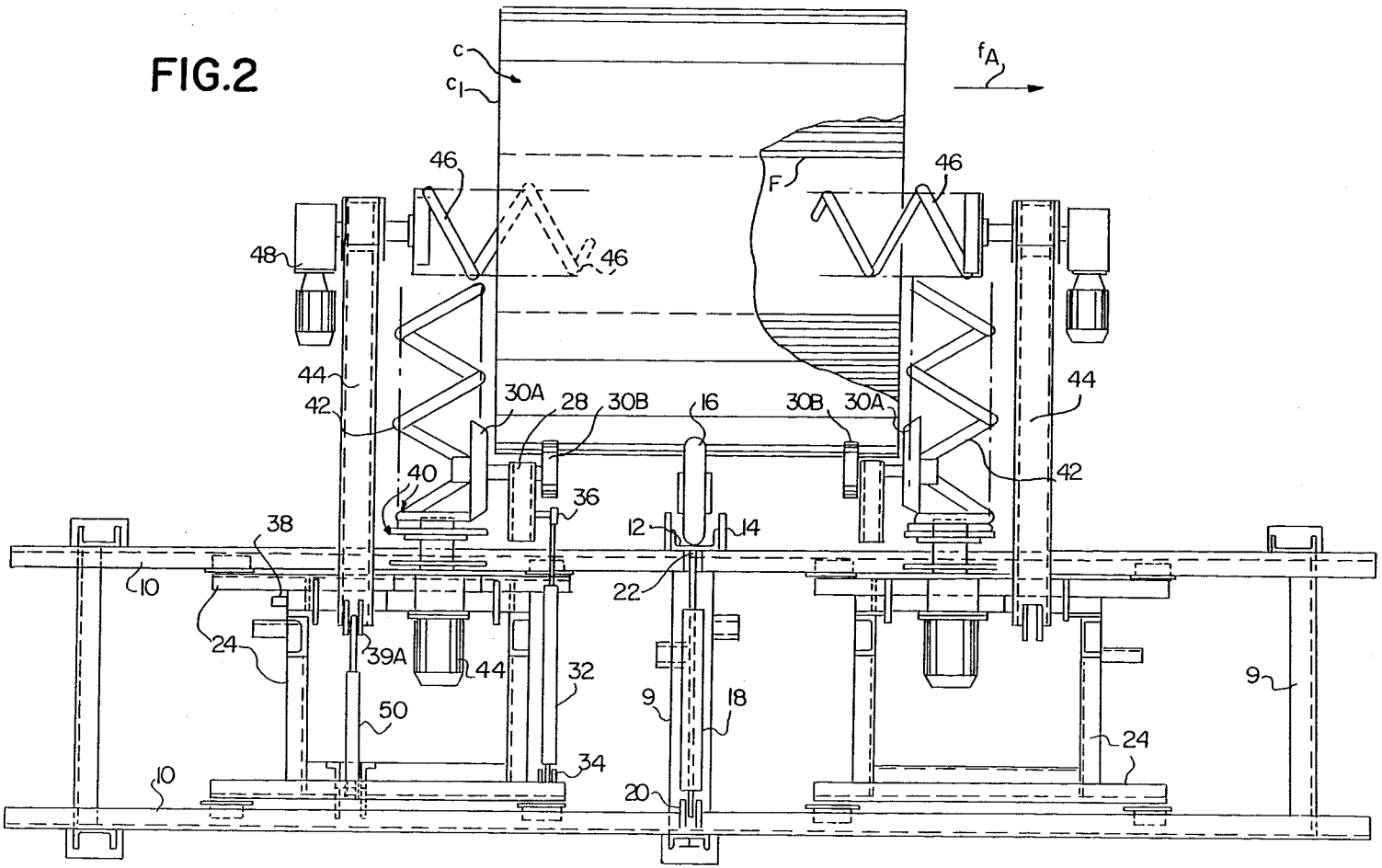
Figure 3:
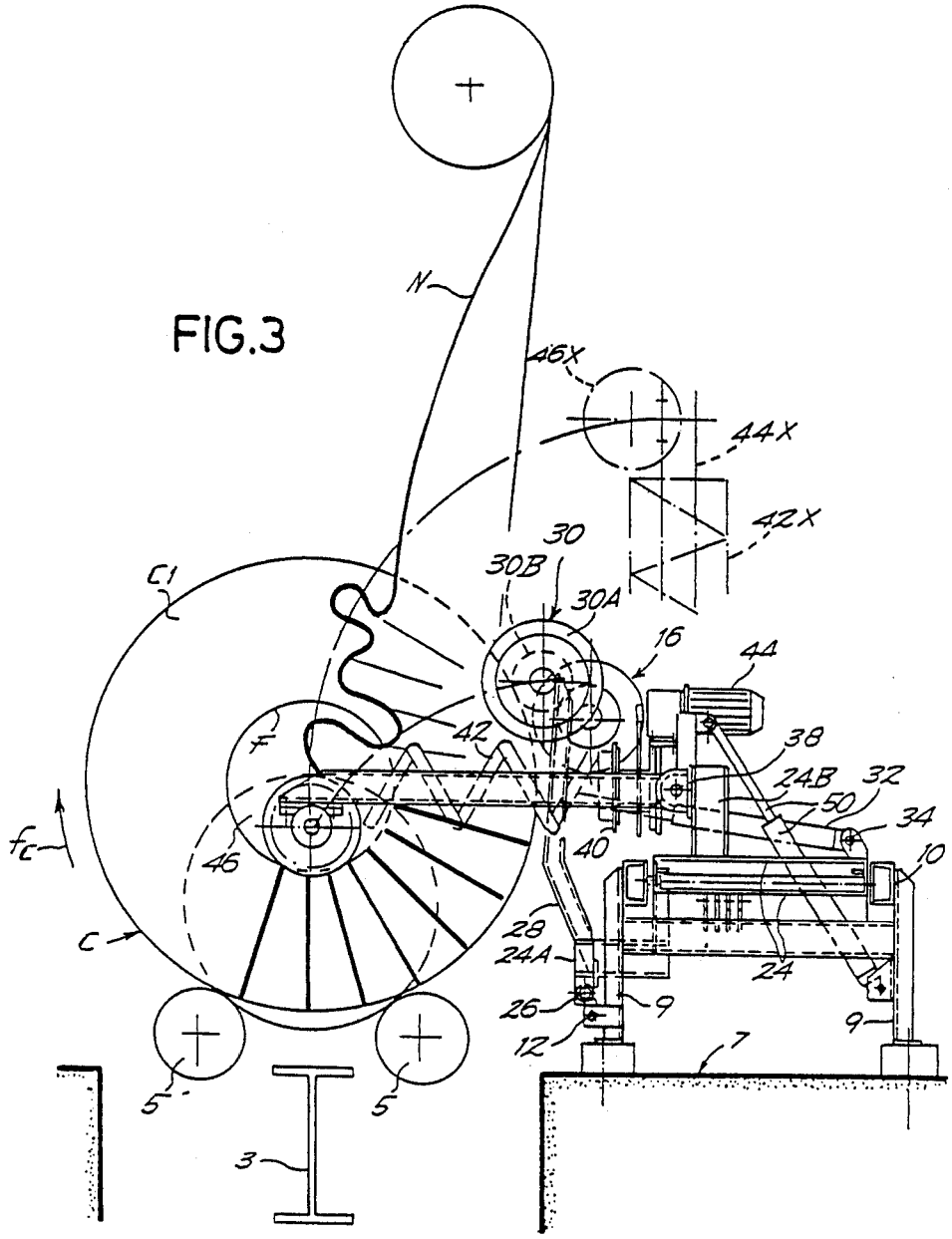

In the drawings, the frontal elevation and layout plan of the machine are shown respectively in FIGS. 1 and 2, while FIG. 3 is a side-view of the machine in the direction of the axis of the coil.

In this non-limitative example, according to present invention a machine works in association with a coil transfer system that serves a number of stations. The transfer system includes a beam (3) working with a series of lifting, advancing, backing and lowering movements to move coils (C) to different stations, in at least part of which (and especially at the station where the machine in question is installed), provision is made for lowering coil C onto a set of rolls (5), so that the coil can revolve in the direction indicated by the arrow $f_C$ (FIG. 3) during the wrapping operation, which begins the packing of coils and is followed by other operations to form a casing (that is usually made using another equipment). As already indicated, the coils travel in a direction parallel to their axis, while the machine according to the invention is installed on a basement (7) facing the station that is fitted with the supporting rolls (5) on which the coil to be wrapped in paper revolves. Basement (7) carries a steel frame (9) that supports two rails or tracks (10), laid parallel to the axis of coil C and to the direction of travel of the coils when they pass from one station to the next (i.e. in the direction of arrow $f_A$ or in the opposite direction). A hinged arm (14) pivots at one end on a pin (12) installed centrally on frame (9) (FIGS. 1 and 2) and is fitted, at the opposite end, with a single median guide roll (16) or with a set of coaxial guide rolls resting on the cylindrical surface of coil C. The guide roll, or rolls, can be backed away from the cylindrical surface of the coil by a hydraulic actuator (18) which is hinged at (20) to frame (9) and, at the opposite end, at (22) to arm (14); guide roll (16) can therefore be pulled away from or pushed towards coil C by operating hydraulic actuator (18).

The two carriages (24) can be power-driven or made to slide manually along rails (10) so as to approach, or back away from, each other and to reach symmetrical, or asymmetrical, positions with respect to the centre of frame (9). Each carriage (24) supports one set of primary folding devices and one set of secondary folding devices. More precisely, each carriage (24) is fitted with a hinged arm (28), similar to arm (14), which pivots at (26) on a bracket (24A) fixed to the carriage underside. Arm (28) carries the said primary folding devices, indicated generally as (30) and comprising a bevelled disk (30A) and a second disk (30B) similar to guide roll (16). Disk (30B) rests on the cylindrical surface of the coil, while disk (30A) presses against the circular side (C1) of the coil. Bevelled disk 30A of the primary folding devices can be backed away from, or pressed against, the circular side (C1) of the coil by sliding carriage (24) in the required direction. Arm (28), like arm (14), can be pulled away from, or pushed towards, the cylindrical surface of the coil by a hydraulic actuator (32) hinged, at one end, to point (34) of the carriage and, at the opposite end, to point (36) of arm (28) so that both disks can be moved towards or away from the coil.

Each carriage (24) is fitted with a pair of short upright supports (24B) that hold above the carriage a horizontal shaft (38) which is parallel to the axis of the coil (i.e. to rails 10) and on which pviots an assembly (39). Assembly (39) includes a journal box for the hub of a rotor (40); rotor (40) is installed with its shaft at right angles to the axis of shaft (38) and is coupled to a stiff self-supporting helix or screw roller (42), the axis of which latter lies in a plane at right-angles to the axis of coil C. Rotor (40) and helix (42) are driven by a geared motor (44), forming part of the said assembly (39) which pivots on shaft (38). Screw roller (42) can consist of bar twisted into the shape of a cylindrical helix; the outer edge of screw roller (42) is rounded and the winding of the helix is almost parallel to the lie of the bevel of disk (30A) of the primary folding devices. Helix (42) forms part of the primary folding devices and completes the first folding operation in the manner described later in this specification.

Assembly (39) also includes a hinged arm (44) pivoting on shaft (38) and positioned, in each of the two assemblies mounted on carriages (24), externally to helix (42) of the primary folding devices. Each arm (44) carries a secondary folding device (46) on its far end, consisting of a helix screw roller similar to helix (42) but with its axis parallel to the axis of coil C. The helix (46) is developed inwards that is in the direction of the helix of the opposite rotor mounted on the other carriage. Each screw roller (46), that is each secondary folding device, is driven by a geared motor (48) mounted on arm (44).

Assembly (39), which pivots on shaft (38), also includes a third hinged arm (39A) connected to a hydraulic actuator (50) that is, in turn, hinged to carriage (24) and controls the pivoting of assembly (39) on shaft (38). By operating actuator (50), it is possible to lower arm (44), rotor (40) and helix (42) (installed on the relative carriage (24)) jointly to a near-horizontal position (indicated in the drawing by unbroken lines) or to raise them to an essentially vertical position, as shown in FIGS. 1 and 3 (chain-like sketches (44X), (46X) and (42X)). When raised to their vertical positions (42X), (44X) and (46X), the various operative components of assembly (39) are removed from the path of coils existing and entering the wrapping station.

The machine operates in the following manner.

After the coil has been placed in position (C1) and has started to revolve in the direction of arrow $f_C$, an automatic dispenser located above the wrapping station feeds out a continuous sheet of paper (N) whose width is greater than that of the cylindrical surface of the coil, so that the sheet can be laid on the cylindrical surface of the coil and then folded onto the circular sides (C1) and into the hollow core (F) of the coil. Sheet (N) is led onto the cylindrical surface of the coil and then wrapped by the primary folding devices which, in the meantime, have been lowered from the vertical position (42X) to a near-horizontal position (rotors (40) and helix (42)) and moved towards the coil (disks (30A) and (30B)) so as to start pleating sheet (N). Guide roll (16) and disks (30B) and (30A) are moved towards the coil either before or immediately after the paper sheet first reaches the cylindrical surface of the coil; the paper sheet is also drawn in between the coil and rolls (5), which support the coil and make it revolve. The open ends of sheet (N) are pleated against the circular sides (C1) of the coil (C) by bevelled disks (30A) and by screw rollers (42). When this first folding operation of the open ends of the paper sheet has been completed, screw rollers (46), which have been inserted to a certain depth in hollow core (F), take over and fold back the edges of the paper ends wrapped around the coil by bevelled disks (30A) and screw rollers (42). As a result of the additional folding operation performed by screw rollers (46), pleated edges are inserted into hollow core (F) and are flattened against the inner wall of the coil, sheathing hollow core (F) up to a certain distance from each end and even making one pleated edge overlap the opposite one at the centre of the core.

The above operations are performed after the coil has been positioned in the wrapping station. While the coil is advancing into the station, carriages (24) are far apart and assemblies (39) are in the vertical position indicated in the drawing by chain-line sketches (42X), (44X) and (46X) of the folding components. After the coil has come to a halt, the wrapping operations are stared by lowering the two assemblies and by sliding the two carriages towards each other, so that screw rollers (46) are inserted to a certain depth in hollow core (F) and screw rollers (42) meet with the circular sides of the coil. Either at the same time as or just before these operations, disks (30A) and (30B) and guide roll(s) (16) are brought into position close to the coil. The entire wrapping operation is completed during a 360° revolution of coil (C), during which sheet (N) is drawn onto the cylindrical surface and follows the rotary movement of the coil. The paper can be fed out either in pre-cut lengths, each sufficient for one wrapping operation, or from a continuous paper reel and cut at the end of each operation; the terminal edge of the sheet wrapped round the coil is then secured in place with a simple fixing operation.

Upon completion of the wrapping operation, the two carriages (24) are backed away from one another so as to withdraw screw rollers (46) from hollow core (F); guide rolls (16) and disk (30B) are then moved away from the cylindrical surface of the coil by swinging back arms (14) and (28) on their pivots, while screw rollers (42) and (46) are raised to their vertical positions (42X) and (46X) by pivoting upwards assemblies (39) by means of actuators (50). In this way, all components are positioned so that they cannot interfere with or impede the axial progress of the outgoing coil or of the next coil entering the station.

Screw rollers (42) and (46) can be advantageously made of helical rods or rods of similar shape and can be sheathed with rubber or with other similar material.

Is is understood that the attached drawing represents an exemplification, which is given only as a practical demonstration of the invention and which in no way limits the extent to which the actual shape and layout of the invention may vary without, however, going beyond the scope of the general principle on which the invention is based. Similarly, the inclusion of reference numbers in the attached claims has the sole purpose of facilitating the reading of the claims through reference to the description and to the drawing and is in no way limitative of the protection required under the claims.

I claim:

1. Machine for wrapping a sheet of material around metal strip coils, comprising:

a dispenser feeding out a sheet of material (N);

means for making a metal strip coil (C) having a cylindrical surface and circular sides revolve on a number of supporting rolls (5);

guide rolls (16, 30B) resting of the cylindrical surface of the coil;

primary folding devices (30A, 42), flanking the said cylindrical surface of the coil, for bending and pleating the open ends of the sheet of material against the circular sides (C1) of the coil, said primary folding devices including slanted disks which flank said circular sides of the coil; and secondary folding devices (46) for bending back the edges of the sheet of material into the hollow core (F) of the coil.

2. Machine according to claim 1, in which said primary folding devices comprise screw rollers (42) which revolve on shafts parallel to said circular sides of the coil.

3. Machine according to claim 2, in which said screw rollers comprise helical rods sheathed with an elastic deformable material.

4. Machine according to claim 1, including two mobile carriages (24) that travel on rails (10), said rails being parallel to the axis of the coil and supporting said primary (30A, 42) and secondary (46) folding devices.

5. Machine according to claim 4, in which said primary and secondary folding devices are hinged to said carriages.

6. Machine according to claim 1, in combination with a transfer system (3) that moves the coils in the direction of their axes, said guide rolls (16, 30) and said primary (30A, 42) and secondary (46) folding devices being all carried by assemblies mounted for movement toward and away from the axis of the coil, so that the coil can advance.

7. Machine according to claim 6, including hinged arms (14, 28) that pivot on shafts parallel to the axis of the coil to carry said primary folding devices.

8. Machine according to claim 1, in which said secondary folding devices comprise screw rollers (46) which revolve on shafts parallel to the axis of the coil and which are inserted to a predetermined depth in a hollow core (F) of the coil, so as to bend back the edges of the sheet material after the latter has been bent and pleated by the primary folding devices, said secondary folding devices being mounted for movement toward and away from each other in order to be inserted into or withdrawn from said hollow core of the coil.

9. Machine according to claim 1, in which said slanted disks are of frustoconical shape.

10. Machine according to claim 1, in which said primary folding devices (30A, 42) are mounted for movement toward and away from each other in a direction parallel to the axis of the coil, so that the gap between them can match the axial length of the coil.

11. Machine for wrapping a sheet of material around metal strip coils, comprising:

a dispenser feeding out a sheet of material (N);

means for making a metal strip coil (C) having a cylindrical surface and circular sides revolve on a number of supporting rolls (5);

guide rolls (16, 30B) resting on the cylindrical surface of the coil;

primary folding devices (30A, 42), flanking the said cylindrical surface of the coil, for bending and pleating the open ends of the sheet of material against the circular sides (C1) of the coil;

hinged arms (14, 28) that pivot on shafts parallel to the axis of the coil to carry said primary folding devices;

secondary folding devices (46) for bending back the edges of the sheet of material into the hollow core (F) of the coil; and a transfer system (3) which moves said coils in the direction of their axes, said guide rolls (16, 30) and said primary (30A, 42) and secondary (46) folding devices being all carried by assemblies mounted for movement toward and away from the axis of the coil, so that the coil may advance.

12. Machine as claimed in claim 11, in which said primary folding devices include slanted disks which flank said circular sides of the coil.

13. Machine according to claim 12, in which said slanted disks are of frustoconical shape.

14. Machine according to claim 11, in which said primary folding devices comprise screw rollers (42) which revolve on shafts parallel to said circular sides of the coil.

15. Machine according to claim 14, in which said screw rollers comprise helical rods sheathed with an elastic deformable material.

16. Machine according to claim 11, including two mobile carriages (24) that travel on rails (10), said rails being parallel to the axis of the coil and supporting said primary (30A, 42) and secondary (46) folding devices.

17. Machine according to claim 16, in which said primary and secondary folding devices are hinged to said carriages.

18. Machine according to claim 11, in which said primary folding devices (30A, 42) are mounted for movement toward and away from each other in a direction parallel to the axis of the coil, so that the gap between them can match the axial length of the coil.

19. Machine according to claim 11, in which said secondary folding devices comprise screw rollers (46) which revolve on shafts parallel to the axis of the coil and which are inserted to a predetermined depth in a hollow core (F) of the coil, so as to bend back the edges of the sheet material after the latter has been bent and pleated by the primary folding devices, said secondary folding devices being mounted for movement toward and away from each other in order to be inserted into or withdrawn from said hollow core of the coil.

* * * * *